US005458465A

United States Patent [19]

von Wieser et al.

[11] Patent Number: 5,458,465

[45] Date of Patent: Oct. 17, 1995

[54] FAN IMPELLER

[75] Inventors: Carlos W. von Wieser, Sao Paulo, Brazil; Huba Öry, Aachen; Hans-Joachim Wöhler, Bochum, both of Germany

[73] Assignee: Balck-Dürr Aktiengesellschaft, Ratingen, Germany

[21] Appl. No.: 191,433

[22] Filed: Feb. 2, 1994

[30] Foreign Application Priority Data

Feb. 2, 1993 [BR] Brazil ..... 9300312

[51] Int. Cl.[6] ..... F04D 29/34; F04D 29/38

[52] U.S. Cl. ..... 416/214 R; 416/230; 416/220 A

[58] Field of Search ..... 416/230, 239, 416/241 A, 234, 220 A, 219 A, 210 R, 214 R, 229 R

[56] References Cited

U.S. PATENT DOCUMENTS

| | | | |
|---|---|---|---|
| 2,155,375 | 4/1939 | Jablonsky | 416/229 R |
| 2,182,812 | 12/1939 | Lougheed | 416/230 |
| 4,260,332 | 4/1981 | Weingart et al. | 416/230 |
| 4,407,635 | 10/1983 | Grimes et al. | 416/230 |
| 4,915,590 | 4/1990 | Eckland et al. | 416/229 R |
| 4,966,527 | 10/1990 | Merz | 416/230 |
| 5,096,384 | 3/1992 | Immell et al. | 416/230 |

FOREIGN PATENT DOCUMENTS

| | | | |
|---|---|---|---|
| 835724 | 12/1938 | France | 416/229 R |
| 2129364 | 10/1972 | France . | |
| 163536 | 5/1921 | United Kingdom | 416/220 A |
| 165548 | 7/1921 | United Kingdom | 416/229 R |

OTHER PUBLICATIONS

Derwent Abstract 90–210875, Hoffmuller et al, pp. 1–2.

Derwent Abstract 88–148459, Sikorski, pp. 1–3.

*Primary Examiner*—Edward K. Look
*Assistant Examiner*—James Larson
*Attorney, Agent, or Firm*—Robert W. Becker & Associates

[57] ABSTRACT

A fan impeller has a hub and fan blade units with fan blades connected to the hub. The fan blade units are made of plastic material reinforced with first fibers for transmitting forces acting on the fan blades into the hub. The first fibers extend substantially parallel to a longitudinal direction of the fan blades. The first fibers are bundled at a radially inner end of the fan blades to form a tubular structure. The tubular structure has a free end that is bent radially outwardly substantially about 180° to form an end ring. The end ring has a convex surface facing the hub and a concave surface facing the fan blade. Each fan blade unit has a fastening element with an annular groove for receiving the end ring, the fastening element connected to the hub. Each fan blade unit further has a fastening ring inserted into the concave surface. The fastening ring clamps the end ring at the fastening element. Screws extend through the fastening ring, the end ring, and the fastening element for connecting the blade unit to the hub.

8 Claims, 1 Drawing Sheet

FAN IMPELLER

BACKGROUND OF THE INVENTION

The present invention relates to a fan impeller designed for fans of cooling towers with fan blades that are made of fiber-reinforced plastic material. The fibers extend substantially parallel and/or at an acute angle to the longitudinal axis of the fan blade and are designed to transmit the forces that collectively act on the fan blades into the impeller hub. The reinforcement fibers at the radially inwardly positioned end of the fan blades are bundled to form a tubular structure and are connected to the hub by fastening rings that engage the outer surface and the inner surface of the tubular structure so as to be rotatable about the longitudinal axis of the fan blade.

Fan impellers of the aforementioned kind are known in various embodiments. In these known constructions the tubular structure of the bundled reinforcement fibers at the radially inwardly positioned end of the blade is widened and into the widened interior a conical inner ring is inserted that together with a conical exterior ring by a wedging action on the fiber bundle clamps the fiber bundle so that the forces acting collectively on the fan blades are transmitted onto the impeller hub.

This known construction has not only the disadvantage of a great axial extension of the clamping elements, but also, depending on the wedging angle, results in a relatively high load of the reinforcement fibers, especially on those located in the area of the inner and outer surfaces of the tubular fiber bundle.

It is therefore an object of the present invention to provide a fan impeller of the aforementioned kind such that, on the one hand, the axial constructive length for the clamping of the tubular fiber bundle is shortened and, on the other hand, the constructive expenditure for the fastening of the reinforcement fibers at the fastening elements as well as for the arrangement of the fastening elements at the impeller hub is reduced to thereby lower the manufacturing costs.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
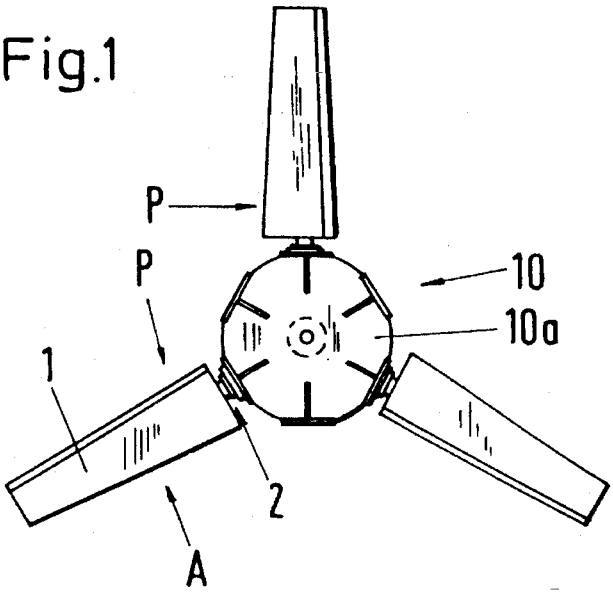
FIG. 1 shows an end view of a three-blade fan impeller.
Figure 2:
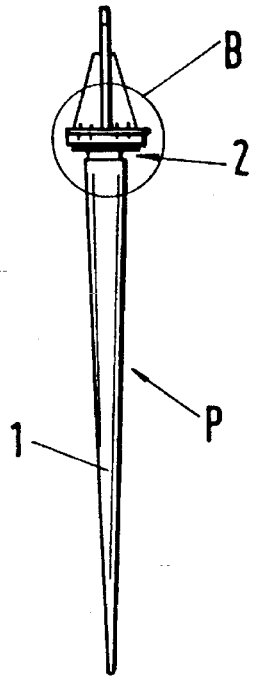
FIG. 2 shows a side view of a fan blade in the direction of arrow A in FIG. 1.

The fan impeller according to the present invention is primarily characterized by:

A hub;

Fan blade units with a fan blade connected to the hub and made of plastic material reinforced with first fibers for transmitting forces acting on the fan blades into the hub;

The first fibers extending substantially parallel to a longitudinal direction of the fan blade units;

The first fibers being bundled at a radially inner end of the fan blades to form a tubular structure;

The tubular structure having a free end that is bent radially outwardly and reversed in direction to form an end ring;

The end ring having a convex surface facing the hub and a concave surface facing the fan blades;

Each fan blade unit having a fastening element with an annular groove for receiving the end ring, the fastening element connected to the hub; and Each fan blade unit having a fastening ring inserted into the concave surface, the fastening ring clamping the end ring at the fastening element.

Preferably, the fastening element has a centering projection projecting into the interior of the tubular structure.

Expediently, the fastening element and/or the fastening ring are made of plastic material.

Advantageously, the fan impeller further comprises ring segments positioned on the fastening ring. Preferably, the hub has a flange and the fastening element comprises screws extending through the ring segments, the fastening ring, the end ring, and the fastening element for connecting the fastening element to the flange.

In a further embodiment of the present invention the fan blades have areal reinforcement embedded in the surface of the fan blades. Preferably, the areal reinforcements are fiber mats. Expediently, the fiber mats are bi-directional and/or multi-directional.

Preferably, the tubular structure has an exterior sleeve, the exterior sleeve preferably reinforced by second fibers that extend transverse to the first fibers.

According to the present invention, the end of the tubular structure of reinforcement fibers is formed to a semi-circular portion by bending the end radially outwardly and forward to thereby provide an end ring that with its convex surface facing the hub is inserted into a rounded annular groove of a disk-shaped fastening element and with its concave surface facing the fan blade is clamped with a fastening ring at the fastening element.

Due to the inventive design of an end ring with a semi-circular cross-section, not only a very short clamping distance in the axial direction is obtained for the reinforcement fibers, but also a simple and secure clamping that ensures the transmission of high forces without loading the semi-circularly bent reinforcement fibers with unsuitably high clamping forces. In contrast to the conventional wedge-shaped clamping connection, the load on the reinforcement fibers is reduced with the inventive design so that the inventive embodiment results in a clamping action and force transmission that is especially suited for fibers.

According to a further embodiment of the invention, the fastening element has a centering projection that projects into the interior of the tubular structure of the fiber bundle. With this measure it is ensured in a simple and safe manner that the fiber bundle with its tubular structure and thus the fan blade is centered at the hub.

In another preferred embodiment of the present invention the fastening elements and/or the fastening rings are made of plastic material. This allows for the embedding of the end ring (made of reinforcement fibers) into the fastening element when the plastic material of the neck of the fan blade unit is not yet completely cured so that a very stable and precise manufacture is possible.

According to a further feature of the present invention, the disk-shaped fastening element of the fan blade can be connected to the hub by ring segments that are positioned on the fastening ring and by screws that extend through the fastening ring, the end ring of the fiber bundle, and the fastening element for engaging a bearing flange of the hub. The inventive connection thus requires only few and simple fastening components.

The fan blade can inventively also be provided with an areal reinforcement embedded in its surface, preferably comprised of bi-directional and/or multi-directional fiber mats.

In order to protect the radially inwardly facing end of the fan blades against damage, according to further embodiments of the invention the neck of the tubular structure of the fiber bundle may be provided with an exterior sleeve. In a preferred embodiment of the invention, this sleeve is provided with second reinforcement fibers extending transverse to the first reinforcement fibers of the fan blade. These second reinforcement fibers surround the tubular structure of the first reinforcement fibers. They protect the tubular structure of the first reinforcement fibers against widening of the fiber bundle and also increase the stability of the neck of the fan blades.

DESCRIPTION OF PREFERRED EMBODIMENTS

The present invention will now be described in detail with the aid of several specific embodiments utilizing FIGS. 1 through 4.

Figure 3:
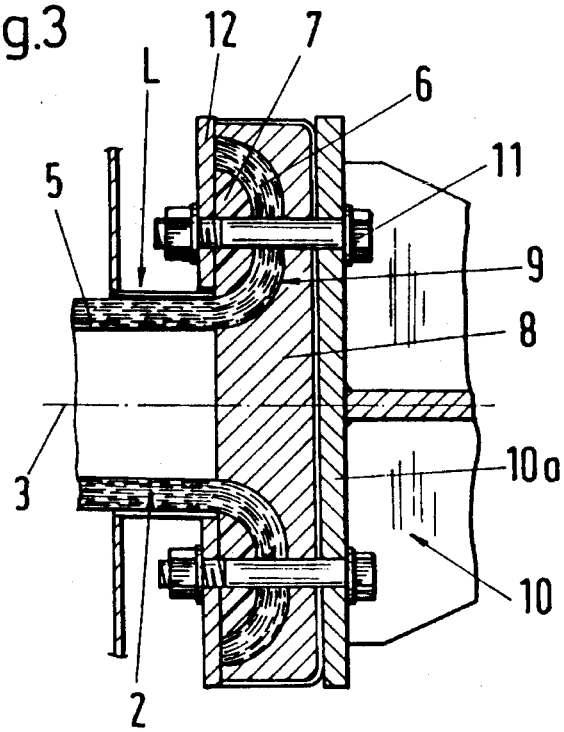
FIG. 3 shows a longitudinal section of the end of the fan blade indicated by circle B in FIG. 2.
Figure 4:
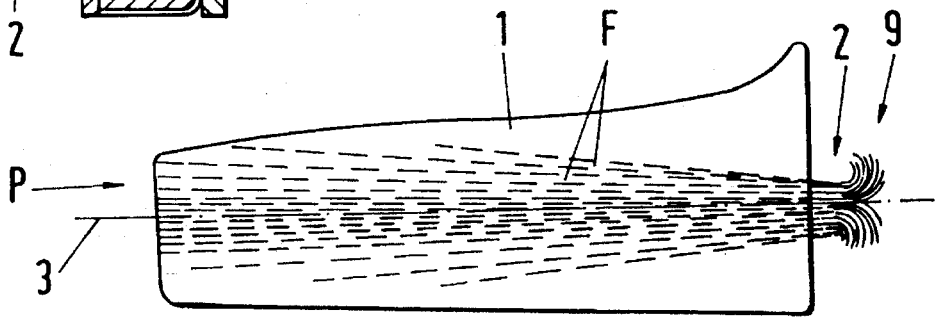
FIG. 4 shows a side view of a fan blade with schematically indicated reinforcement fibers.

The fan impeller represented in FIG. 1 has three fan blade units P that are connected with a neck 2 to the hub 10. The fan blades 1 are made of fiber-reinforced plastic material in a hollow or massive construction with a suitable cross-section. In FIG. 4 it is schematically shown that the fan blade unit P has reinforcement fibers F for transmitting the forces acting collectively on the fan blade 1 into the hub 10. The reinforcement fibers F extend substantially parallel and/or at an acute angle to the longitudinal axis 3 of the fan blade 1, which axis 3 is represented in FIGS. 3 and 4. In the context of this application the wording "substantially parallel" also includes the positioning of the reinforcement fibers at an acute angle as shown in FIG. 4.

The reinforcement fibers F at the radially inwardly oriented end of the fan blade 1 are bundled to form a fiber bundle of a tubular structure 5 whereby the cross-section of the tubular structure 5 of the fiber bundle shown in FIG. 3 may be circular or oval and in its axial extension may be cylindrical or conical.

As is shown in FIG. 3, the end of the tubular structure 5 of the reinforcement fibers F is bent first radially outwardly and subsequently forward (substantially bent about 180°) in order to form a semi-circular bend so that all reinforcement fibers F form an end ring 6 having a cross-section as shown in FIG. 3. This representation also shows that the convex surface facing the hub 10 of this end ring 6 is inserted into a rounded annular groove 9 of a disk-shaped fastening element 8. The concave surface of the end ring 6 facing the fan blade 1 has inserted therein a fastening ring 7 that is preferably made of plastic material like the fastening element 8.

The reinforcement fibers F that within the fan blade 1 have a fan-shaped arrangement (see FIG. 4) are clamped with their ends forming the end ring 6 between the fastening ring 7 and the fastening element 8 and are connected with the aid of the disk-shaped flange 10*a* at the hub 10. In the shown embodiment this connection is achieved with screws 11 that penetrate the flange 10*a* of the hub 10 as well as the fastening element 8, the end rings 6, and the fastening ring 7. In order to distribute the forces resulting from the screw onto a greater surface area, the fastening ring 7 is provided with ring segments 12 that are shown in cross-section in FIG. 3.

The fastening ring 7 as well as the disk-shaped fastening element 8 are made of a suitable material, preferably of reinforced plastic material. With this measure it is possible to imbed the end ring 6 into the annular groove 9 of the fastening element 8 and connect it with the fastening ring 7 while the plastic material of the neck 2 has not yet completely hardened. The surfaces of the annular groove 9 within the fastening element 8 and the fastening ring 7 are rounded with great radii in order to prevent damage to the fiber bundle/tubular structure 5 and in order to ensure a transmittal of forces acting on the fan blade 1 via the end ring 6 formed by the fiber bundle 5 into the hub 10 in a manner that is suitable for the reinforcement fibers. The optionally pre-stressed reinforcement fibers F of the fiber bundle/tubular structure 5 extend parallel to the longitudinal axis 3 and are thus substantially subjected to pulling forces and very little bending and pressure loads; they are not subjected to any shearing forces so that the described fastening of the reinforcement fibers, even under consideration of great load cycles to which the fan blades 1 are subjected, ensures a high fatique strength.

As can be seen especially in FIG. 3, the described connection requires only a very short axial constructive length. Due to the centering projection of the fastening element 8 projecting into the interior of the tubular structure 5 of the fiber bundle a simple and effective centering of the fan blade 1 relative to the hub 10 is achieved. With suitable measures each fan blade 1, optionally even when the fan impeller is rotating, can be rotated about its longitudinal axis 3. For protecting the fiber bundle, its tubular structure 5 may be provided with an exterior sleeve L, preferably comprised of second reinforcement fibers that extend transverse to the first reinforcement fibers of the fiber bundle. These second fibers surrounding the tubular structure 5 of the fiber bundle represent an additional reinforcement of the neck 2 which further increases the high fatigue resistance (strength) of the described connection.

The inventive design results in a construction in which the reinforcement fibers F of the fan blade 1 are exclusively loaded by forces that can be easily transmitted by the reinforcement fibers F, i.e., essentially only pulling forces and only minimal bending and compression forces are exerted onto the fibers. The reinforcement fibers F furthermore are not subjected to any shearing, cutting, and tearing forces in the area of the neck 2 and, due to the compression of the fastening ring 7 and the fastening element 8, are only subjected to non-damaging pressure loads.

The present invention is, of course, in no way restricted to the specific disclosure of the specification and drawings, but also encompasses any modifications within the scope of the appended claims.

What we claim is:

1. A fan impeller comprising:

a hub with a flange;

fan blade units with a fan blade connected to said hub and made of plastic material reinforced with first fibers for transmitting forces acting on said fan blades into said hub;

said first fibers extending substantially parallel to a longitudinal direction of said fan blade units;

said first fibers being bundled at a radially inner end of said fan blade to form a tubular structure;

said tubular structure having a free end that is bent radially outwardly and reversed in direction to form an end ring;

said end ring having a convex surface facing said hub and a concave surface facing said fan blade;

each said fan blade unit having a fastening element with an annular groove for receiving said end ring, said fastening element connected to said flange of said hub and said annular groove having an inner contour matching said convex surface of said end ring;

each said fan blade unit having a fastening ring inserted into said concave surface, wherein the surface of said fastening ring inserted into said concave surface matches said concave surface of said end ring; and screws extending through said fastening ring, said end ring, said fastening element, and said flange of said hub for clamping said end ring between said fastening ring and said fastening element to thereby fasten said fan blade units to said flange of said hub.

2. A fan impeller according to claim 1, wherein said fastening element has a centering projection projecting into the interior of said tubular structure.

3. A fan impeller according to claim 1, wherein said fastening element is made of plastic material.

4. A fan impeller according to claim 1, wherein said fastening ring is made of plastic material.

5. A fan impeller according to claim 1, wherein said fastening ring and said fastening element are made of plastic material.

6. A fan impeller according to claim 1, further comprising ring segments positioned on said fastening ring, wherein said screws extend through said ring segments, said fastening ring, said end ring, said fastening element and said flange.

7. A fan impeller according to claim 1, wherein said tubular structure has an exterior sleeve.

8. A fan impeller according to claim 7, wherein said exterior sleeve is reinforced by second fibers extending transverse to said first fibers.

* * * * *